US005918586A

United States Patent [19]

Von Dungen et al.

[11] Patent Number: 5,918,586

[45] Date of Patent: Jul. 6, 1999

[54] HIGH SPEED CUTTING BELT

[76] Inventors: Eric Von Dungen, 14 Northwood Dr., Williamsville, N.Y. 14221; Alfred J. Ulrich, 11433 Broadway, Alden, N.Y.; Greg Gorecki, 35022 Schintzius Rd., Eden, N.Y. 14057

[21] Appl. No.: 08/964,047

[22] Filed: Nov. 4, 1997

Related U.S. Application Data

[XX .

[60] Provisional application No. 60/030,713, Nov. 8, 1996.

[51] Int. Cl.[6] ..... B28D 1/08

[52] U.S. Cl. ..... 125/21; 451/355; 198/846

[58] Field of Search ..... 125/21; 451/355; 198/846

[56] References Cited

U.S. PATENT DOCUMENTS

| | | | |
|---|---|---|---|
| 4,637,511 | 1/1987 | Johnson et al. | 198/846 |
| 5,184,598 | 2/1993 | Bell | 125/21 |
| 5,305,730 | 4/1994 | Fish | 125/21 |
| 5,603,311 | 2/1997 | Hoerner et al. | 125/21 |
| 5,735,259 | 4/1998 | Hoerner et al. | 125/21 |

*Primary Examiner*—Timothy V. Eley
*Assistant Examiner*—Daniel G. Shanley
*Attorney, Agent, or Firm*—Wall Marjama Bilinski & Burr

[57] ABSTRACT

The present invention is a high speed cutting belt for cutting aggregate and non-aggregate, natural stone and composite building materials with steel or non-steel reinforced materials. The cutting belt comprises a tensile member base, a plurality of cutting segments welded to metal carriers and crimped to the tensile member base, and molded in urethane to form a continuous, flexible belt, said belt having less than 90° "V" shaped inner bottom side surfaces and a flat, outer top and inner bottom surface.

3 Claims, 4 Drawing Sheets

HIGH SPEED CUTTING BELT

RELATED APPLICATION

This application is a Continuation-In-Part of Provisional patent application Ser. No. 60/030,713, Filed Nov. 8, 1996.

BACKGROUND OF THE INVENTION

1. Field of the Invention

This invention relates generally to cutting devices and more particularly to a high speed cutting belt for cutting various aggregate and non-aggregate, natural stone and composite building materials having steel or non-steel reinforcing.

2. Prior Art

Cutting concrete, stone, and other hard, brittle materials is a grinding or abrading action rather than a peeling action as in chip removal of a soft ductile material. Typically such materials are cut with cutting segments composed of a metal matrix with hard, abrasion resistant particles such as industrial diamonds randomly distributed therein. The segments are attached to a cutting tool such as the periphery of a circular blade, chain links, or a steel cable. Most commonly used are the circular blade and the chain.

The circular blade is driven by a shaft through the blade center with an arbor flange securing the blade to the shaft. A major disadvantage is that the blade has to be approximately three times larger than the desired depth of cut. A combination of the cost of a large blade and the cost of a large power head required to drive such a blade makes the equipment very expensive. Another disadvantage with a circular saw is that cutting out square corners is not possible without using another tool or cutting past the desired intersection point. The chain saw, by comparison, can cut the same depth of cut as a circular saw with a fraction of the power and can also make square corners without cutting past the desired intersection point.

Several problems exist with the saw chain that are not present for the circular saw. The saw chain involves several parts sliding against each other. The side links and center links pivot relative to each other on rivets, the bottom surface of the side links slides on the guide bar rails, and the center drive tang slides in the guide bar groove. When cutting hard, brittle material, the fine particles that are produced from the cutting operation get between the sliding parts of the saw chain links and the guide bar and acts as an abrasive, wearing the hardest of steel surfaces. The additional clearance between the rivets and the links increases the center-to-center distance between the drive tangs. This causes inefficiencies and additional wear on the drive sprocket due to the change in pitch diameter of the chain. It also inconveniences the operator to frequently adjust the tension of the chain and it ultimately stretches the chain beyond the adjustable limits of the saw.

Another problem is that the saw chain traveling in the saw kerf can wear the rivet heads, causing an increase in power to pull the chain through the kerf and posing a safety issue.

It is desirable that a saw chain for cutting hard, brittle material be better adapted to withstand the abrasion present in such cutting environments. The subject of the present invention provides these and other advantages.

A previous attempt to address these issues, U.S. Pat. No. 5,735,259, was a cutting belt in which the cutting segments were brazed atop of a flat stainless steel tensile member, or brazed onto anchors with either a single loop of wire rope tensile member with both ends permanently joined running through it, or a double wire rope continuous loop tensile member running through it, or a wire rope tensile member with multiple winds that were not mechanically joined.

There were several problems with the prior belt maintaining the alignment of the segments, maintaining the relative distance between the segments and the rapid fatigue of the tensile member.

A high speed cutting belt has not been successfully developed prior to this invention to withstand the extreme abuse that is encountered when cutting hard, brittle material.

SUMMARY OF THE INVENTION

The present invention, a high speed cutting belt, provides features to overcome the problems encountered when cutting hard, brittle materials such as various aggregate and non-aggregate, natural stone and composite building materials with steel or non-steel reinforced materials. The high speed cutting belt is to be used in conjunction with the belt based cutting system which consists of the power head, drive sheave, guide bar with a nonrotating nose, and an automatic tensioning system (ATS). It is designed for use on both a hand-held and/or mounted tool.

The wearing of linkages by abrasive materials has been overcome by eliminating the chain links. The tensile member rapidly fatiguing has been eliminated by using a tensile member base consisting of multiple winds of a polyaramide (or aromatic polyamide cord, such as that sold under the trademark KEVLAR(TM), molded in a single plane with a polymer. To eliminate any stress concentrations, the diamond impregnated cutting segments are not directly attached to the tensile cord, but welded to metal carriers which then are mechanically fastened to the polymer surrounding the polyramide cord. The mechanical fastening also eliminates the cutting segments from slipping along the axis of the tensile member. A polymer is molded over the entire base and the segments forming a continuous, flexible belt.

DESCRIPTION OF THE PREFERRED EMBODIMENT

Figure 1:
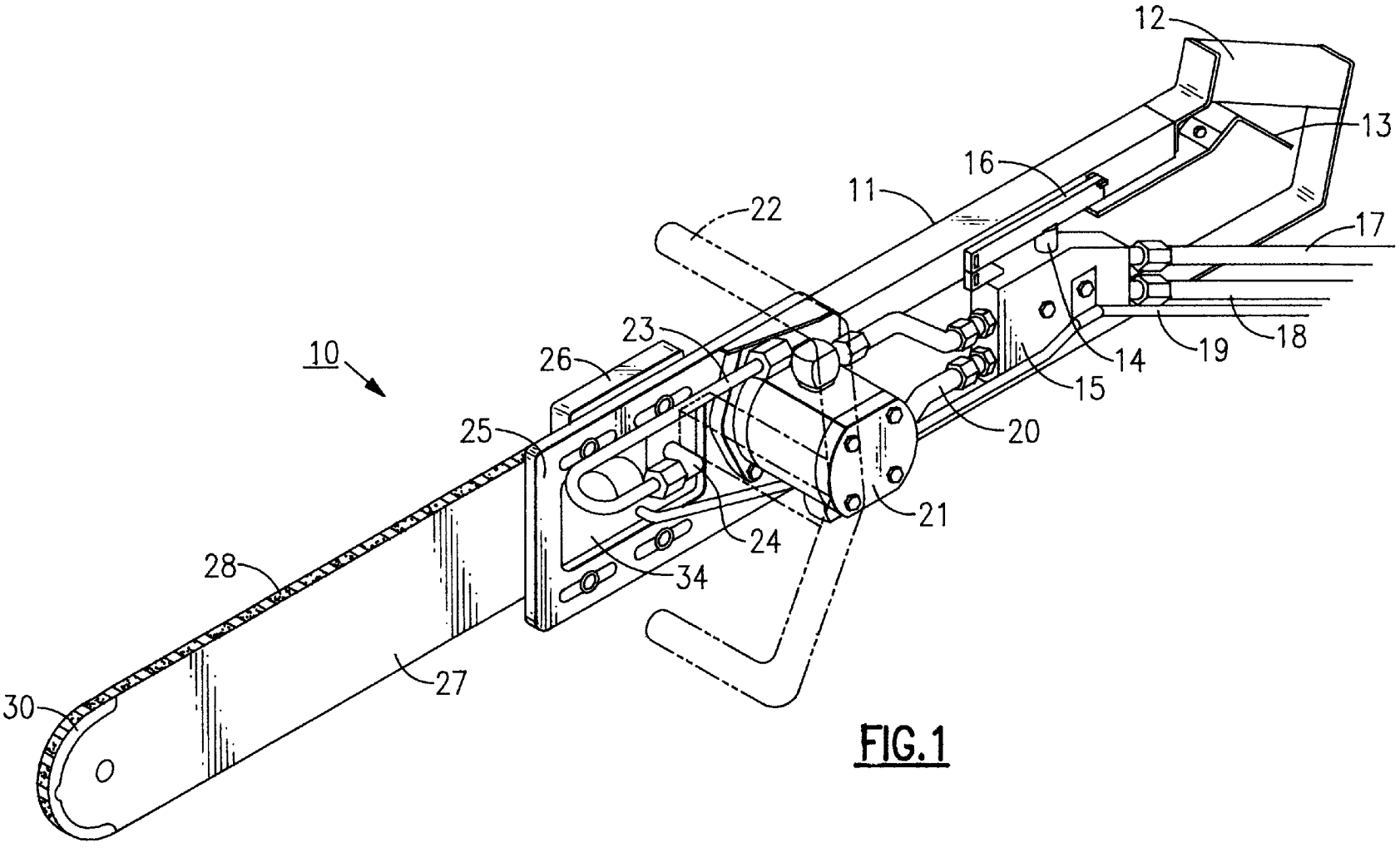
FIG. 1 is a top perspective view of a belt based cutting system in accordance with the invention.
Figure 2:
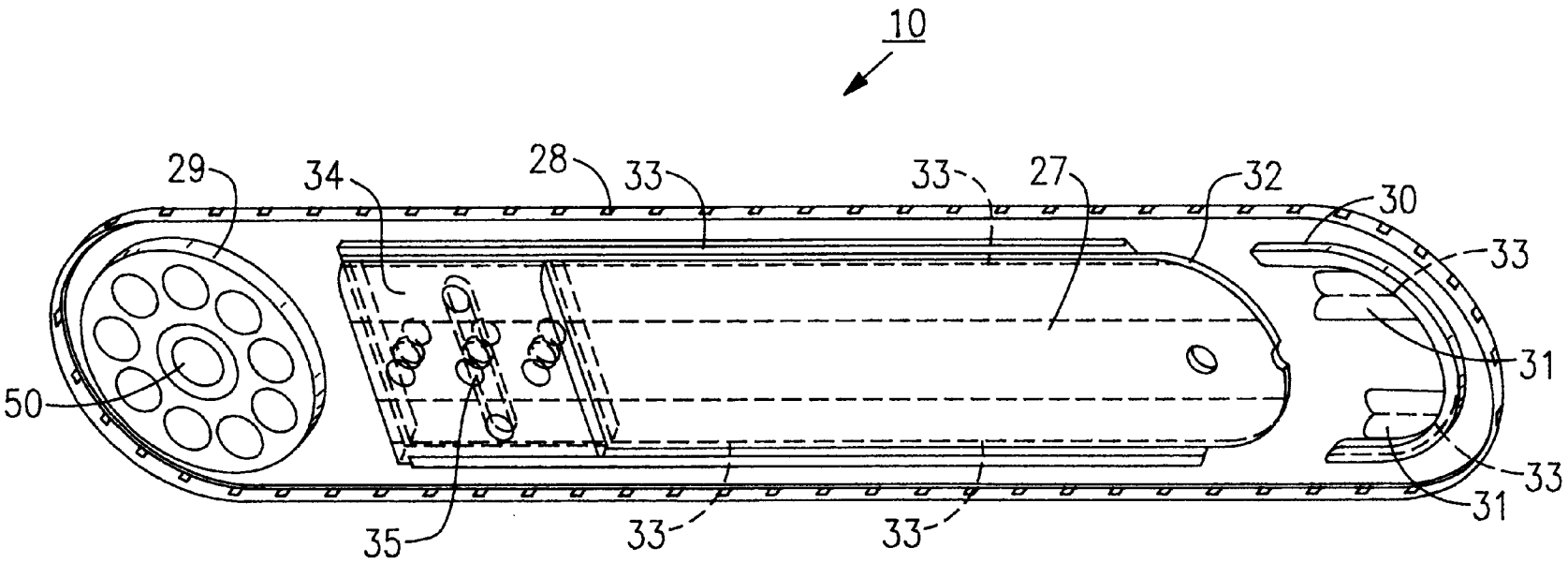
FIG. 2 is a top perspective view of the guide bar assembly of the invention.
Figure 3:
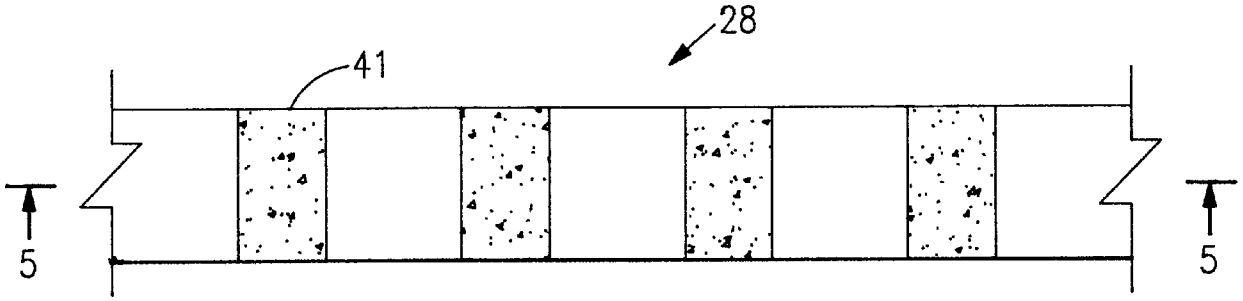
FIG. 3 is a top view of the high speed cutting belt of the invention.
Figure 5:
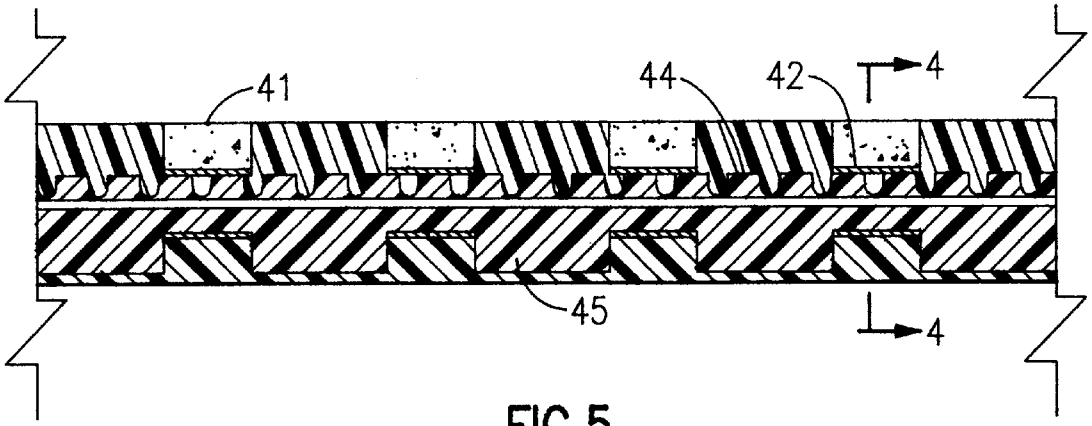
FIG. 5 is a sectional view of the belt in FIG. 4 along the lines 4—4.
Figure 4:
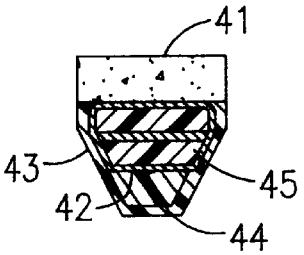
FIG. 4 is a sectional view of the belt in FIG. 3 along the lines 4—4, rotated 90°.
Figure 6:
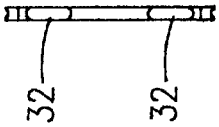
FIG. 6 is an end view of the guide bar for the cutting belt of the invention.
Figure 7:
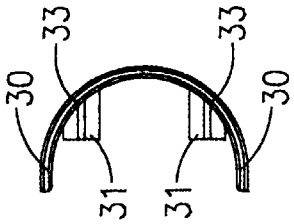
FIG. 7 is a side view of the bar nose for the cutting belt of the invention.
Figure 8:
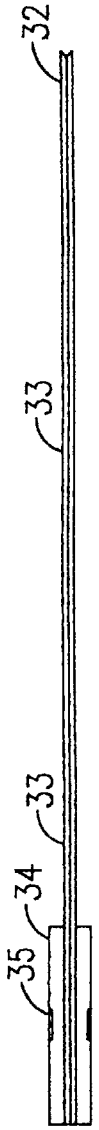
FIG. 8 is a top view of the guide bar of the invention.
Figure 9:
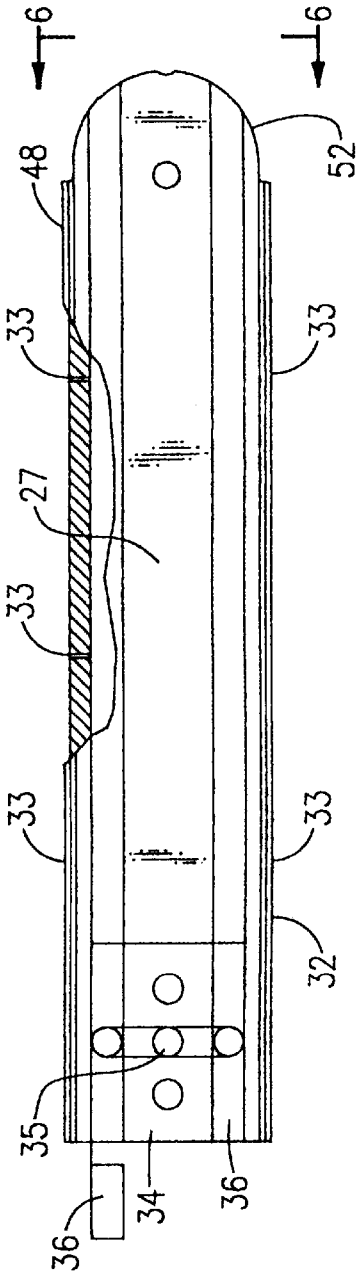
FIG. 9 is a side view of the guide bar for the cutting belt of the invention.

FIG. 1 illustrates the belt based cutting system which is generally indicated by the numeral 10. FIG. 1 shows the power head consisting of a frame 11, a handle 12, an on-off trigger 13, a valve spool 14, a valve body 15, an actuator lever 16, oil inlet 17, oil outlet 18, oil line 23, water hose 19, oil lines 20 to hydraulic motor 21, and handle 22 shown in dotted lines. Guide bar 27 is held between mounting flange 25 and bar clamp 26. Cutting belt 28 is mounted on the guide bar 27, over nose 30 and over the drive sheave 29 shown in FIG. 2. The drive sheave 29, having tapered bore 50. will have a "V" shaped groove to provide the maximum coefficient of friction. The Auto Tensioning System (ATS) 24 provides the correct tension on the cutting belt 28. The belt based cutting system is manufactured by R.G.C. Corporation, P.O. Box 681, Buffalo, N.Y. 14240, and is only described in general terms.

The belt based cutting system 10 features an off-on trigger 12 that requires only a single operator input to start or stop the hydraulic motor 21, turn the water supply to the bar, on or off, and activate the Automatic Tensioning System (ATS) 24. The Automatic Tensioning System (ATS) 24 tensions the cutting belt 28 to the proper tension and compensates for any stretching of the belt 28 that may occur. Maintaining the proper belt tension helps maintain the stability of the belt 28. When the trigger 13 is released, the belt tension is reduced to zero, aiding in the removal of the belt 28.

The guide bar 27, mounted on bar mount 34, has an integral water distribution system consisting of bar nose tangs 31, which fit within two internal water reservoirs 32, water inlet 35, and reservoir plugs 36, that distribute water to several orifices 33 along the "V" groove 48 of the guide bar 27, orifices 33 in the bar nose 30, and orifices 33 directed at the drive sheave 29. The water distributed along the "V" groove of the guide bar 27 provides lubrication allowing the belt 28 to slide along the guide bar 27 with a minimum of friction and flushes the abrasive particles away from the "V" groove 48. Water distributed to the bar nose 30 provides hydrodynamic floating of the belt 28 around the bar nose 30 with minimal horsepower losses and flushes the abrasive particles away from the "V" groove 48. Water directed towards the drive sheave 29 flushes the abrasive particles from the "V" groove. The water distribution system also provides cooling for the belt 28, carrying away the heat generated by the cutting operation.

The wear in the "V" groove 48 of the guide bar 27 is minmized by a hard, wear-resistant coating (not shown) and by preventing abrasive particles from entering into the groove 48 through the sealing effect of the belt 28. The sealing effect is produced by a combination of the thin film of water between the belt 28 and groove 48 and the positive water pressure under the belt 28.

The highly wear resistant, one piece, non-rotating bar nose 30, sliding in groove 52, eliminates several problems of a more conventional system like the chain saw. Several wearing components like the inner race, bearings and nose sprocket are not needed. Additionally, without any points of positive engagement, there is no problem with the change of pitch.

The power is transmitted to the belt 28 by a high coefficient of friction "V" groove sheave 29, having tapered bore 50. The groove angle shall be two degrees greater than the belt 28 to provide the belt to seat in the lower region of the belt 28. Water is directed into the groove 48 to provide flushing of abrasive particles and to carry away any heat generated in the friction drive.

Maintaining the belt 28 in the "V" groove 48 of the guide bar 27 and the bar nose 30 will result in a very stable, straight, smooth, cutting operation. The low segment height/belt height to width aspect ratio stabilizes the belt 28. The small segment mass minimizes the centrifugal effects, allowing the belt 28 to stay in the groove 48 and minimizing the strain on the tensile member base 44.

The cutting belt 28 is comprised of a plurality of equally spaced cutting segments 41 attached to a tensile member base 44. The tensile member base 44 consists of multiple winds of polyaramide cord 45 molded in a single plane with a polymer. To eliminate any stress concentrations, the diamond impregnated cutting segments 41 are not directly attached to the polyaramide cord 45, but welded to metal carriers 42 which then are mechanically fastened to the polymeric material 43 surrounding the polyaramide cord. The mechanical fastening also prevents the cutting segments 41 from slipping along the axis of the tensile member base 44. The tensile member base 44, and segments 41 are completely encased in a highly wear resistant polymeric material 43, forming a continuous, flexible belt 28.

The polymeric material 43 wears down at the same rate as the metal matrix of the cutting segment 41. This provides a relatively smooth transition between segments 41, virtually eliminating any "hook-up" during the cutting operation and minimizing the strain on the tensile member base 44.

What is claimed is:

1. A high speed cutting belt for cutting various aggregate and non-aggregate, natural stone, and composite building materials with steel or non-steel reinforced materials, said cutting belt comprising:

a tensile member base consisting of polymeric material surrounding multiple winds of a polyaramide cord held in a single plane by said polymeric material, a plurality of cutting means mechanically fastened to said base, said cutting means consisting essentially of a metal matrix and diamonds, said cutting means being spaced apart along said base, and urethane plastic molded over said tensile member base and said cutting means, and thereby forming a continuous, flexible belt, said belt having less than 90° "V" shaped bottom inner side surfaces and flat, outer top and inner bottom surfaces.

2. The cutting belt of claim 1 wherein said cutting segments are welded to metal carriers and crimped to said tensile member base.

3. A high speed cutting belt for cutting various aggregate and non-aggregate, natural stone, and composite building materials with steel or non-steel reinforced materials, said cutting belt comprising:

a tensile member base consisting of polymeric material surrounding multiple wraps of polyaramide cords held in a single plane with said polymeric material, a plurality of cutting segments welded to metal carriers and crimped to said tensile member base, and urethane plastic molded over said tensile member base and said cutting means, and thereby forming a continuous, flexible belt, said belt having less than 90° "V" shaped bottom inner side surfaces and flat, outer top and inner bottom surfaces.

* * * * *